US012180657B2

(12) United States Patent
Pierce

(10) Patent No.: US 12,180,657 B2
(45) Date of Patent: Dec. 31, 2024

(54) PICK-UP PRESS DEVICE AND METHOD OF PRODUCING A 3D-MOLDED PRODUCT FROM A PULP SLURRY

(71) Applicant: Celwise AB, Norrköping (SE)

(72) Inventor: David Pierce, Norrköping (SE)

(73) Assignee: Celwise AB, Norrköping (SE)

( * ) Notice: Subject to any disclaimer, the term of this patent is extended or adjusted under 35 U.S.C. 154(b) by 293 days.

(21) Appl. No.: 17/419,910

(22) PCT Filed: Jan. 3, 2020

(86) PCT No.: PCT/EP2020/050061
§ 371 (c)(1),
(2) Date: Jun. 30, 2021

(87) PCT Pub. No.: WO2020/141209
PCT Pub. Date: Jul. 9, 2020

(65) Prior Publication Data

US 2022/0081846 A1 Mar. 17, 2022

(30) Foreign Application Priority Data

Jan. 3, 2019 (SE) ..... 1950004-0

(51) Int. Cl.
*D21J 5/00* (2006.01)

(52) U.S. Cl.
CPC ..... *D21J 5/00* (2013.01)

(58) Field of Classification Search
CPC ..... D21J 5/00; D21J 7/00; D21J 3/00; B29C 33/00; B29C 51/00
See application file for complete search history.

(56) References Cited

U.S. PATENT DOCUMENTS 2,938,582 A 5/1960 Chaplin
2,996,118 A * 8/1961 Chaplin ..... D21J 7/00 162/411

(Continued)

FOREIGN PATENT DOCUMENTS

CA 2400836 A1 2/2003
CN 1297086 A 5/2001

(Continued)

OTHER PUBLICATIONS

Swedish First Office Action and Search Report for Swedish Application No. 1950004-0, mailed Jun. 25, 2019, (11 pages).

(Continued)

*Primary Examiner* — Jose A Fortuna
(74) *Attorney, Agent, or Firm* — Kagan Binder, PLLC

(57) ABSTRACT

The document relates to a pick-up press device for use in a process of producing a 3D molded product from a pulp slurry comprising a pick-up press tool presenting a porous first product face; a press tool presenting a second product face; and a vacuum source, connected to the pick-up press tool. The pick-up press tool and the press tool are vertically movable relative one another, wherein, in a first relative position of the press tools, at least one of the product faces is positioned so as to receive a pulp slurry layer in liquid form to its product face, and wherein in a second relative position of the press tools, the product faces are pressed towards each other for pressing the pulp slurry layer. The device further comprises a first transfer tool, wherein the first transfer tool comprises a first forming surface portion, configured to conform to a first portion of the porous first product face, such that a forming gap is defined there between, said forming gap defining a desired pulp slurry layer thickness; and a second forming surface portion, configured to diverge from a second portion of the porous first product face, such that a non-forming space is defined (Continued)

by the second forming surface portion and a second portion of the porous first product face, said non-forming space having a greater thickness than the forming gap.

16 Claims, 4 Drawing Sheets

(56) References Cited

U.S. PATENT DOCUMENTS

| | | | | |
|---|---|---|---|---|
| 3,016,091 | A * | 1/1962 | Daniele | D21J 7/00 137/596.17 |
| 3,075,872 | A | 1/1963 | Reifers | |
| 3,477,908 | A | 11/1969 | Daniele | |
| 5,356,518 | A | 10/1994 | Kelley et al. | |
| 6,174,388 | B1 | 1/2001 | Sikka et al. | |
| 6,582,562 | B2 * | 6/2003 | Gale | B33Y 70/00 249/141 |
| 6,605,187 | B1 | 8/2003 | Nonomura et al. | |
| 8,062,477 | B2 * | 11/2011 | Appleford | D21J 3/00 162/134 |
| 8,246,784 | B2 * | 8/2012 | Nilsson | D21J 3/00 162/226 |
| 9,149,948 | B2 | 10/2015 | Kuo et al. | |
| 9,650,746 | B2 | 4/2017 | Choda et al. | |
| 9,739,016 | B2 | 8/2017 | Kuo et al. | |
| 9,803,322 | B2 | 10/2017 | Kuo et al. | |
| 10,240,286 | B2 * | 3/2019 | Chung | D21J 7/00 |
| 10,377,547 | B2 * | 8/2019 | Chung | B31B 50/142 |
| 10,435,848 | B2 * | 10/2019 | Andersson | D21J 7/00 |
| 10,683,611 | B2 * | 6/2020 | Chung | D21J 3/00 |
| 11,391,001 | B2 * | 7/2022 | Andersson | D21J 7/00 |
| 11,479,919 | B2 * | 10/2022 | Parker | D21J 1/06 |
| 11,738,485 | B2 * | 8/2023 | Gonzalez | B29C 41/38 264/517 |
| 11,753,223 | B2 * | 9/2023 | Berk | B65D 11/04 156/69 |
| 2004/0013830 | A1 | 1/2004 | Nonomura et al. | |
| 2008/0047676 | A1 | 2/2008 | Takagi et al. | |
| 2010/0330312 | A1 | 12/2010 | Stockhaus | |
| 2012/0319335 | A1 * | 12/2012 | Nilsson | B22F 5/007 264/628 |
| 2016/0168793 | A1 | 6/2016 | Kuo et al. | |
| 2016/0168800 | A1 | 6/2016 | Kuo et al. | |
| 2016/0168801 | A1 | 6/2016 | Kuo et al. | |
| 2016/0244917 | A1 | 8/2016 | Kuo et al. | |
| 2016/0368235 | A1 | 12/2016 | Kuo et al. | |
| 2017/0370049 | A1 * | 12/2017 | Andersson | B22F 3/1109 |
| 2018/0086511 | A1 | 3/2018 | Lin | |
| 2018/0340296 | A1 * | 11/2018 | Chung | D21H 27/10 |
| 2019/0194870 | A1 * | 6/2019 | Kuo | D21H 19/82 |
| 2019/0218711 | A1 * | 7/2019 | Chung | D21J 3/00 |
| 2019/0284764 | A1 | 9/2019 | Kuo et al. | |
| 2019/0301102 | A1 | 10/2019 | Kuo et al. | |
| 2019/0376238 | A1 | 12/2019 | Andersson et al. | |
| 2019/0376239 | A1 * | 12/2019 | Andersson | B22F 5/007 |
| 2021/0138696 | A1 * | 5/2021 | Gonzalez | B29C 41/38 |
| 2021/0269983 | A1 * | 9/2021 | Pierce | D21J 7/00 |
| 2021/0292974 | A1 * | 9/2021 | Pierce | B32B 23/10 |
| 2022/0049432 | A1 * | 2/2022 | Pierce | D21J 3/10 |
| 2022/0081846 | A1 * | 3/2022 | Pierce | D21J 3/00 |
| 2022/0081847 | A1 * | 3/2022 | Pierce | B29C 33/06 |
| 2022/0403604 | A1 * | 12/2022 | Andersson | D21J 5/00 |
| 2023/0331425 | A1 * | 10/2023 | Ishii | B65D 1/34 |
| 2023/0392322 | A1 * | 12/2023 | Pierce | D21J 7/00 |
| 2023/0399157 | A1 * | 12/2023 | Berk | B65D 65/466 |

FOREIGN PATENT DOCUMENTS

| | | | | |
|---|---|---|---|---|
| CN | 1307154 | A | 8/2001 | |
| CN | 1360109 | A | 7/2002 | |
| CN | 204849488 | U | 12/2015 | |
| CN | 205443807 | U | 8/2016 | |
| CN | 205688279 | U | 11/2016 | |
| CN | 206493510 | U | 9/2017 | |
| DE | 102017219812 | A1 | 5/2019 | |
| DE | 10201800344 | A1 | 10/2019 | |
| EP | 1197596 | A1 | 4/2002 | |
| EP | 1815066 | A2 | 8/2007 | |
| EP | 2757194 | A | 7/2014 | |
| GB | 900378 | A | 7/1962 | |
| GB | 2301790 | A | 12/1996 | |
| GB | 2456502 | A | 7/2009 | |
| JP | S51011905 | A | 1/1976 | |
| JP | S6440699 | A2 | 2/1989 | |
| JP | H0742100 | A | 2/1995 | |
| JP | H08302597 | A | 11/1996 | |
| JP | 2000289729 | A | 10/2000 | |
| JP | 2001140198 | A | 5/2001 | |
| JP | 2001182000 | A | 7/2001 | |
| JP | 2005002529 | A | 1/2005 | |
| JP | 2018501415 | A * | 1/2018 | D21J 7/00 |
| KR | 19990078526 | A | 11/1999 | |
| KR | 20190000074 | U | 1/2019 | |
| NL | 6712454 | A | 7/1968 | |
| SE | 2250048 | A1 * | 8/2023 | B65D 43/02 |
| TW | M511949 | U | 11/2015 | |
| TW | M515462 | U | 1/2016 | |
| TW | M515566 | U | 1/2016 | |
| TW | M519157 | U | 3/2016 | |
| TW | 201711926 | A | 4/2017 | |
| TW | I621751 | B | 4/2018 | |
| WO | 9722755 | A1 | 6/1997 | |
| WO | 03035980 | A1 | 5/2003 | |
| WO | 2006057609 | A1 | 6/2006 | |
| WO | 2006057610 | A2 | 6/2006 | |
| WO | 2006057611 | A1 | 6/2006 | |
| WO | 2007084067 | A1 | 7/2007 | |
| WO | 2007106026 | A1 | 9/2007 | |
| WO | 2007129972 | A1 | 11/2007 | |
| WO | 2011059391 | A1 | 5/2011 | |
| WO | 2011059392 | A1 | 5/2011 | |
| WO | 2011059393 | A1 | 5/2011 | |
| WO | 2011059394 | A1 | 5/2011 | |
| WO | 2011065911 | A1 | 6/2011 | |
| WO | 2011159240 | A1 | 12/2011 | |
| WO | 2012005683 | A1 | 1/2012 | |
| WO | 2012033449 | A1 | 3/2012 | |
| WO | 2016101976 | A1 | 6/2016 | |
| WO | 2018237279 | A1 | 12/2018 | |
| WO | 2020016407 | A1 | 1/2020 | |
| WO | 2020016409 | A1 | 1/2020 | |
| WO | 2020016411 | A1 | 1/2020 | |
| WO | 2020016413 | A2 | 1/2020 | |
| WO | 2020016416 | A2 | 1/2020 | |
| WO | WO-2020141209 | A1 * | 7/2020 | D21J 3/00 |

OTHER PUBLICATIONS

International Preliminary Report on Patentability for International Application No. PCT/EP2020/050061, mailed Jul. 15, 2021, (7 pages).

International Search Report and Written Opinion for International Application No. PCT/EP2020/050061, mailed Mar. 31, 2020, (12 pages).

Chinese Office Action, and English Translation thereof, for Chinese Application No. 202080007884.7, mailed Sep. 14, 2023, (31 pages).

Japanese Office Action, and English Translation thereof, for Japanese Application No. 2021-538390, mailed Nov. 21, 2023, (9 pages).

Communication of a Notice of Opposition for European Application No. 20700096.9, mailed Mar. 12, 2024, (35 pages).

* cited by examiner

PICK-UP PRESS DEVICE AND METHOD OF PRODUCING A 3D-MOLDED PRODUCT FROM A PULP SLURRY

CROSS-REFERENCE TO RELATED APPLICATIONS

This application claims priority to International Application No. PCT/EP2020/050061, filed Jan. 3, 2020 and titled "A PICK-UP PRESS DEVICE AND METHOD OF PRODUCING A 3D-MOLDED PRODUCT FROM A PULP SLURRY," which in turn claims priority from a Swedish Patent Application having serial number 1950004-0, filed Jan. 3, 2019, titled "A PICK-UP PRESS DEVICE AND METHOD OF PRODUCING A 3D-MOLDED PRODUCT FROM A PULP SLURRY," both of which are incorporated herein by reference in their entireties.

TECHNICAL FIELD

The present document relates to a pick-up press device for use in a process of molding a product from pulp slurry. The disclosure also relates to a method of molding a product from a pulp slurry.

BACKGROUND

It is known to mold products from a pulp slurry by dipping a porous mold into a pulp slurry and subsequently drying and optionally pressing the thus molded product. Examples of such products are egg cartons, shock absorbing packaging inserts and paper trays, paper cups, drink carry out trays, mushroom and berry boxes and other forms of industrial, agricultural and consumer packaging.

In respect to the molding of products from pulp it is desirable to provide a mold that is durable and can be subjected to elevated temperatures. Further, smooth surface structures, reduced energy consumption, and improved quality control of the forming process are desirable.

In regard to these aspects, WO2016101976 A1 discloses an improved tool or tool part for use in molding a product from slurry, comprising a self-supporting tool wall portion having a product face, for contacting the product, and a back face on the other side of the wall relative to the product face. The tool wall portion presents pores, which are provided by a plurality of channels extending through the tool wall portion, from the product face to the back face. Such a tool or tool part is also capable of providing an efficient pickup, transfer or evaporation of pulp used, or molding the product, while requiring less energy for vacuum generation as compared to other known tools.

However, it is desirable to further reduce the energy consumption.

WO2016101976 A1 further discloses a method of molding a product from a pulp slurry by applying the slurry layer to a porous mold and removing water from the slurry by simultaneously heating and pressing the slurry layer while drawing vacuum through a mold wall, the other side of which being in contact with the slurry layer. The molding process may be performed in two or more successive pressing steps, which is advantageous as it shortens cycle time and thus increases the throughput of the production process, as compared to a process with a single pressing step.

However, it is desirable to further increase the throughput.

SUMMARY

It is an object of the present disclosure, to provide an improved pulp molding device for molding a product from a pulp slurry, more specifically providing a device that increases the throughput of the molding process, as compared to prior art.

It further lies within the object of the present disclosure to provide an improved molding process, more specifically providing a method of molding a product from a pulp slurry with increased throughput of the production process.

The invention is defined by the appended independent claims. Embodiments are set forth in the appended dependent claims and in the following description and drawings.

According to a first aspect, there is provided a pick-up press device for use in a process of producing a 3D molded product from a pulp slurry comprising a pick-up press tool presenting a porous first product face, a press tool presenting a second product face, and a vacuum source, connected to the pick-up press tool, wherein the pick-up press tool and the press tool are vertically movable relative one another, wherein, in a first relative position of the press tools, at least one of the product faces is positioned so as to receive a pulp slurry layer in liquid form to its product face, and wherein in a second relative position of the press tools, the product faces are pressed towards each other for pressing the pulp slurry layer. The device further comprises a first transfer tool, wherein the first transfer tool comprises a first forming surface portion, configured to conform to a first portion of the porous first product face, such that a forming gap is defined there between, said forming gap defining a desired pulp slurry layer thickness, and a second forming surface portion, configured to diverge from a second portion of the porous first product face, such that a non-forming space is defined by the second forming surface portion and the second portion of the porous first product face, said non-forming space having a greater thickness than the forming gap.

For the purpose of the present disclosure, the term "pulp" should be construed so as to include materials comprising fibers such as cellulose, minerals and starch, or combinations of these materials. The pulp preferably has a liquid carrier, which may comprise water.

By "product face" is meant a surface of the tool that is adapted to be in contact with a pulp slurry layer or pulp product during forming of such a pulp product.

The second product face may be porous or non-porous. Alternatively, the second product face may present porous portions and non-porous portions.

The vacuum source may be in form of a vacuum chamber connected to a pressure regulator.

By "pick up" is meant causing pulp fibers to be drawn to the porous first product face of the pick-up press tool.

In the second relative position of the pick-up press tool and the press tool, wherein the product faces are pressed towards each other for pressing the pulp slurry, at least one of the tools can be adapted to supply heat to the product face of the tool. Further, at least one of the tools, having a porous product face or presenting a porous portion, can be connected to a vacuum source, such that a vacuum can be drawn through the porous product face of the tool.

As the pick-up press tool is adapted to both pick up a pulp slurry layer and press the pulp slurry layer, the need for an additional transfer tool for transferring the pulp layer from a pick-up tool to a press tool is eliminated.

Furthermore, as the pick-up press tool and press tool also is vertically movable relative one another, an efficient process for picking up and pressing the pulp slurry layer can be achieved, thereby shortening the cycle time and increasing the throughput of the process.

The first transfer tool can be adapted to transfer the pulp slurry layer from the pick-up press tool to a product face of a second pair of press tools.

The first transfer tool may be connected to a pressure regulator, which is capable of generating a vacuum or an air pressure.

The first transfer tool may also be mounted on a transfer tool holder.

As a non-forming space is defined by the second forming surface portion and a second portion of the porous first product face, at least a portion of the pulp slurry layer can be free during said transfer.

The free portion of the pulp slurry layer can be formed as the pulp slurry layer is transferred from the first transfer tool to a product face of the second pair of press tools, thereby bringing the free portion of the pulp slurry layer into contact with the second forming surface portion of the first transfer tool.

Further, as the first transfer tool is adapted to transfer the pulp slurry layer to a second pair of cooperating press tools and form at least a portion of the pulp slurry layer during the transfer, additional forming or pressing steps may be eliminated, and a shorter cycle time and increased throughput of the process can be achieved.

Further, as the first transfer tool is adapted such that at least a portion of the pulp slurry layer is in contact with a first forming surface portion of the first transfer tool during a transfer, and at least a portion is free, i.e. not in contact, a pulp slurry layer presenting different portions having different levels of water content can be provided.

The pick-up press tool may be provided with at least one heating element adapted to supply heat to the porous first product face of the pick-up press tool. Alternatively, or additionally, the press tool may be provided with at least one heating element adapted to supply heat to the second product face of the press tool.

In the second relative position of the press tools, the product faces may be pressed towards each other for pressing the pulp slurry layer, while heating the pulp slurry layer by means of the at least one heating element and drawing a vacuum through a porous product face of at least one of the tools.

The non-forming space can be configured to provide contact between only one pulp slurry layer face and one of the second forming surface portion and the second portion of the porous first product face.

By "pulp slurry layer face" is meant a surface of the pulp slurry layer adapted to be in contact with a product face of a tool, such as a pick-up press tool, a press tool or a transfer tool.

The non-forming space can present a space between the second forming surface portion and the second portion of the porous first product face, that is greater than 20× a thickness of the forming gap, preferably greater than 15×, greater than 10×, or greater than 5× said thickness of the forming gap.

The non-forming space can be provided at an innermost portion of a female mold and/or at a distal portion of a male mold, as seen in the press direction.

Alternatively, the non-forming space can be provided at an outermost portion of a female mold and/or at a distal portion of a male mold, as seen in the press direction.

The female mold may be a pick-up press tool or a press tool. The male mold may be a transfer tool.

The forming gap can present a thickness that is small enough for both the first forming surface portion and the first portion of the porous first product face to contact a respective pulp slurry layer face.

The forming gap can be configured to provide a pressure on the pulp slurry layer that is greater than ambient pressure.

The first forming surface portion can presents present a contact surface area corresponding to 10-99.9% of the total area of the porous first product face, preferably 25-95%.

The first transfer tool can present a porous product face having a porosity of 10-90%.

For the purpose of the present disclosure, the term "porosity" is defined as pore opening area to total product face area (including the pore openings) of a predetermined product face portion.

The porous product face of the first transfer tool can presents pores with a hole size of 0.1-0.7 mm in diameter, preferably 0.25-0.6 mm.

The porous first product face of the pick-up press tool can have a porosity of 10-90%.

The porous first product face of the pick-up press tool can present pores with a hole size of 0.1-0.7 mm in diameter, preferably 0.25-0.6 mm.

The pick-up press tool can be provided with at least one heating element, adapted to supply heat to the porous first product face of the pick-up press tool.

The heating element may be an electric heating element, hot air or liquid heating element, or induction heating element. The heating element may be controlled by a controller.

The press tool can be provided with at least one heating element, adapted to supply heat to the second product face of the press tool.

The heating element may be an electric heating element, hot air or liquid heating element, or induction heating element. The heating element may be controlled by a controller.

According to a second aspect of the present invention, there is provided a method of producing a 3D molded product from a pulp slurry, comprising: applying, in liquid form, a pulp slurry layer to a porous first product face of a pick-up press tool of a first mold; in a first forming step, pressing the pulp slurry layer on the porous first product face of the pick-up press tool against a second product face of a cooperating press tool of the first mold, while heating the pulp slurry layer and drawing a vacuum through a porous product face of at least one of the tools; transferring the pulp slurry layer to a porous product face of a first press tool of a second mold; in a second, subsequent, forming step, pressing the pulp slurry layer against a second product face of a second press tool of the second mold, while heating the pulp slurry layer and drawing a vacuum through a porous product face of at least one of the first and second press tools of the second mold, wherein at least a portion of the pulp slurry layer is formed during the transfer to the first press tool of the second mold.

Optionally a washing step of the pulp slurry layer may be performed before the second forming step.

The pick-up press tool and the cooperating press tool of a first mold, and/or the first and second press tools of a second mold may form part of a pick-up press device according to what has been described above.

The transfer of the pulp slurry layer from the first mold to the second mold can be performed by means of a first transfer tool, the first transfer tool comprising a first forming surface portion and a second forming surface portion, wherein, during a transfer of the pulp slurry layer from the first mold to the first transfer tool, the first forming surface portion conforms to a first portion of the porous first product face of the first mold, such that a forming gap is defined there between, said forming gap defining a desired pulp slurry layer thickness, and wherein the second forming surface portion diverges from a second portion of the porous first product face of the first mold, such that a non-forming space is defined by the second forming surface portion and the second portion of the porous first product face of the first mold, said non-forming space having a greater thickness than the forming gap.

The first transfer tool may be porous.

The first transfer tool may form part of a pick-up press device according to what has been described above.

During a transfer of the pulp slurry layer from the first mold to the first transfer tool, the forming gap can provide a pressure on the pulp slurry layer that is greater than ambient pressure.

During a movement of the first transfer tool from the first mold to the second mold, the first forming surface portion can be in contact with a pulp slurry layer face and the second forming surface portion can be free.

During the transfer of the pulp slurry layer from the first mold to the second mold, a vacuum can be drawn through the first transfer tool such that at least some water is evacuated from the pulp slurry layer.

A vacuum may be applied when the pulp slurry layer is received by the first transfer tool, i.e. transferred from the first mold to the first transfer tool, and/or during movement of the transfer tool from the first mold to the second mold.

The pulp slurry layer transferred to the second mold may present a first pulp slurry layer portion and a second pulp slurry layer portion, wherein the first and second pulp slurry layer portions are juxtaposed and the first pulp slurry layer portion has a higher or lower level of water content than the second pulp slurry layer portion.

The pick-up of the pulp slurry layer can be achieved by immersing the porous first product face of the pick-up press tool into a bath containing the pulp slurry while drawing vacuum through the porous first product face of the pick-up press tool, such that a pulp slurry layer is applied to the product face.

The pick-up press tool can be moved vertically upwardly from the bath into contact with the cooperating press tool.

Alternatively, the pulp slurry layer can be applied to the porous first product face of the pick-up press tool by spraying or pouring.

A first pressure at a rear side of the porous first product face during the pick-up of the pulp slurry layer can be 300-700 mbarA, preferably 400-600 mbarA.

In the first forming step, a second pressure at a rear side of a porous product face of the first mold can be lower than a third pressure, in the second forming step, at a rear side of a porous product face of the second mold.

The second pressure can be 1-99% of the third pressure, preferably 50-99% or 90-99%.

The second pressure can be 200-900 mbarA, preferably 300-800 mbarA.

In the first forming step, the second product face of the cooperating press tool of the first mold can be heated to about 150-400° C., preferably 200-300° C.

In the first forming step, the porous first product face of the pick-up press tool of the first mold can be heated to about 100-150° C.

The porous first product face of the pick-up press tool may be heated in the first forming step for purpose of an additional drying effect of the pulp slurry layer or for the purpose of maintaining fiber warmth for formability.

In the first forming step, the pulp slurry layer can be pressed against the second product face of the first mold with a pressure of about 390-1570 kPa, preferably 580-1170 kPa.

In the first forming step, the pulp slurry layer can be pressed against the second product face of the first mold during a first pressing time of 0.1-4.0 second, preferably 0.5-2.0 second.

In the first forming step, an initial water content of the pulp slurry layer can be 70-90% by weight and a final water content can be 45-65% by weight, preferably about 50-60% by weight.

The third pressure can be 200-900 mbarA, preferably 300-800 mbarA.

In the second forming step, at least one of the product faces of the second mold can be heated to about 110-400° C., preferably 200-300° C.

In the second forming step, the pulp slurry layer can be pressed against the second product face of the second mold with a pressure of about 390-1570 kPa, preferably 580-1170 kPa.

In the second forming step, the pulp slurry layer can be pressed against the second product face of the second mold during a second pressing time of 0.1-4.0 second, preferably 0.5-2.0 second.

In the second forming step, an initial water content of the pulp slurry layer can be about 45-65%, preferably about 50-60% by weight, and a final water content can be about 25-40% by weight, preferably about 30-35% by weight.

The method can further comprise transferring the pulp slurry layer to a porous product face of a first press tool of a third mold, and in a third, subsequent, forming step, pressing the pulp slurry layer against a second product face of a second press tool of the third mold, while heating the pulp slurry layer and drawing a vacuum through a porous product face of at least one of the first and second press tools of the third mold.

Optionally a washing step of the pulp slurry layer can be performed before the third forming step.

The transfer of the pulp slurry layer can be performed by means of a second transfer tool.

The third pressure at a rear side of a porous product face of the second mold can be lower than a fourth pressure at a rear side of a porous product face of the third mold.

The fourth pressure can be 200-900 mbarA, preferably 300-800 mbarA.

In the third forming step, at least one of the product faces of the third mold can be heated to about 100-300° C., preferably 200-280° C.

In the third forming step, the pulp slurry layer can be pressed against the second product face of the third mold with a pressure of about 390-1570 kPa, preferably 580-1170 kPa.

In the third forming step, the pulp slurry layer can be pressed against the second product face of the third mold during a third pressing time of 0.1-4.0 second, preferably 0.5-2.0 second.

In the third forming step, an initial water content of the pulp slurry layer can be about 25-45% or 25-40% by weight, preferably about 30-40% or 30-35% by weight, and a final water content can be less than about 5% by weight, preferably less than about 1% by weight.

According to a third aspect of the present invention, a method of forming a receptacle is provided, according to what have been described above, wherein the non-forming space is provided at a respective portion of a press tool and transfer tool corresponding to an opening portion of the receptacle.

The receptacle may be a container, cup, jar, tin, bottle etc. adapted to contain a solid, liquid and/or gaseous content. It can be used as a container for various products such as for example personal care products, home care products, food or beverages etc.

The opening portion may present a rim of the receptacle.

According to a fourth aspect of the present invention, a system for producing a 3D molded product from a pulp slurry is provided, the system comprising: a pick-up press device according to what has been described above, and a second pair of cooperating press tools.

The second pair of cooperating press tools may each be mounted to a respective tool holder. At least one of the tools of the second pair of cooperating press tools may present a porous product face. At least one of the tools may be connected to a vacuum source.

The system can further comprise a second transfer tool, and a third pair of cooperating press tools.

The second transfer tool can be adapted to transfer a pulp slurry layer from the second pair of press tools to a product face of the third pair of press tools.

The second transfer tool may be connected to a pressure regulator, which is capable of generating a vacuum or an air pressure.

The second transfer tool may also be mounted on a transfer tool holder.

The third pair of cooperating press tools may each be mounted to a respective tool holder. At least one of the tools of the third pair of cooperating press tools may present a porous product face. At least one of the tools may be connected to a vacuum source.

DETAILED DESCRIPTION

Figure 1A:
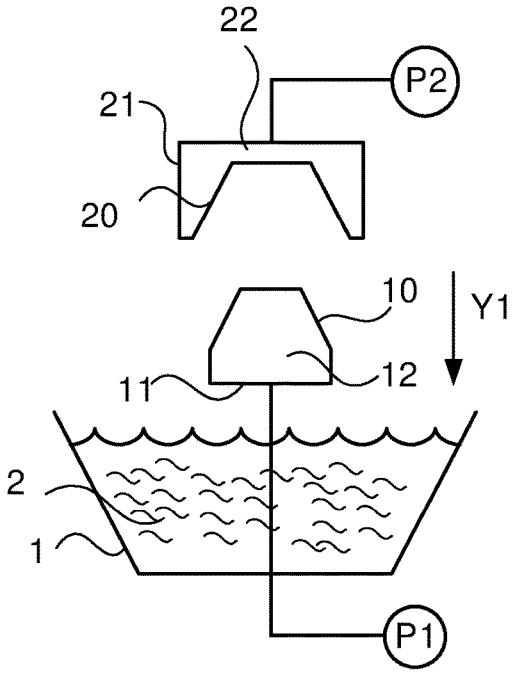
FIGS. 1*a*-1*d* schematically illustrate a pair of pick-up press tools of a pick-up press device.

FIG. 1*a* schematically illustrates a pick-up press tool 10, a cooperating press tool 20, and a container 1 with a pulp slurry 2.

The pick-up press tool 10 is adapted to both pick up a pulp slurry layer 3 from a pulp slurry 2, and press the pulp slurry layer 3 in a first pressing step.

The pick-up press tool 10 is mounted to a tool holder 11, which together with the pick-up press tool defines a vacuum chamber 12 that is connected to a pressure regulator P1. The pressure regulator may have the capability of selectively generating an at least partial vacuum (i.e. air pressure lower than ambient air pressure) and/or an air pressure greater than ambient air pressure.

The pick-up press tool can be self-supporting, meaning that a tool wall portion of the tool is sufficiently rigid and has a melting point that is sufficiently high for the tool wall portion not to require any support structure for maintaining its shape during operation.

The pick-up press tool 10 presents a porous first product face, i.e. a porous surface of the tool that is adapted to be in contact with a pulp slurry layer or pulp product during forming of such a pulp product. The porosity of the porous first product face may be 10-90%.

The porous first product face may further present pores with a hole size of 0.1-0.7 mm in diameter, preferably 0.25-0.6 mm.

As illustrated in FIG. 1*a*, the press tool 20 can also be mounted to a tool holder 21. The tool holder 21 can together with the press tool 20 define a vacuum chamber 22. The vacuum chamber 22 can be connected to a pressure regulator P2. The pressure regulator may have the capability of selectively generating an at least partial vacuum (i.e. air pressure lower than ambient air pressure) and/or an air pressure greater than ambient air pressure.

The press tool 20 presents a second product face. The second product face may be porous or non-porous. Alternatively, the second product face may present porous portions and non-porous portions.

The pick-up press tool 10 and press tool 20 are vertically movable relative one another.

In a first relative position of the press tools 10, 20, at least one of the product faces is positioned so as to receive the pulp slurry 3, which can be in liquid form, to its product face, see FIG. 1*a*.

Figure 1B:
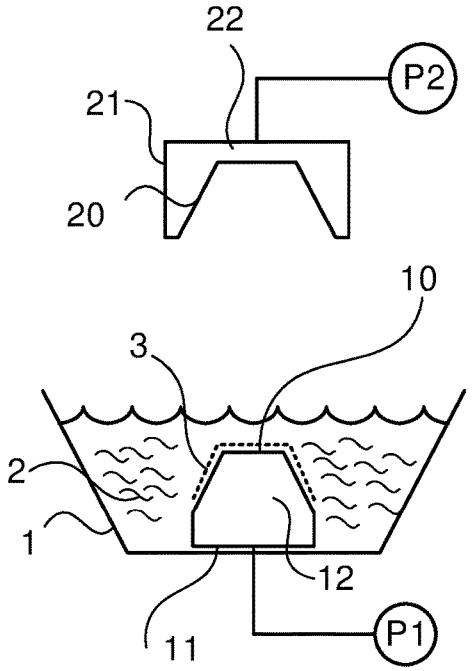
Figure 1C:
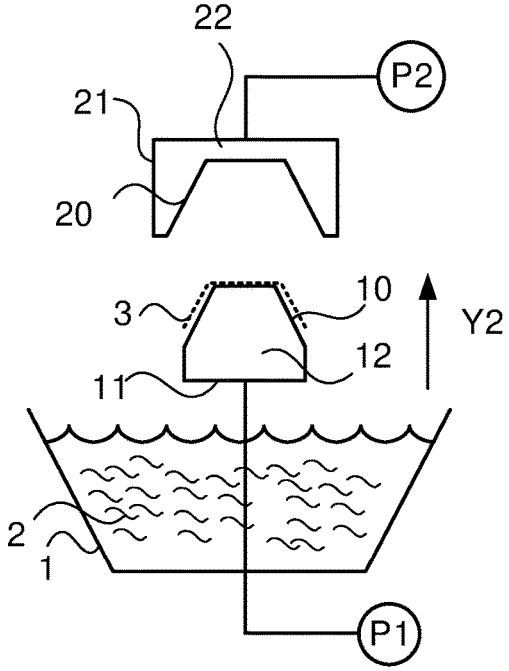
Figure 1D:
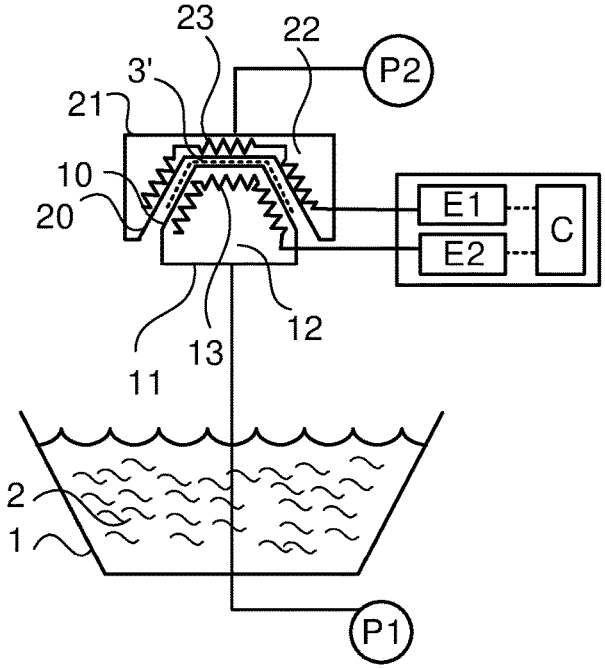

In a second relative position of the press tools 10, 20, the product faces are pressed towards each other for pressing the pulp slurry layer, see FIG. 1*d*.

Consequently, the pick-up press tool 10 can maintain its orientation in relation to the press tool 20 from the pick-up of the pulp slurry layer to the pressing of pulp slurry layer.

Further, the pick-up press tool 10 can be moved in a direction Y1 for initiating the step of picking up the pulp slurry layer 3 from the container 1 with the pulp slurry 2, see FIG. 1 *a*.

Further, the pick-up press tool 10 can be moved in a direction Y2 for initiating the step of pressing the pulp slurry layer 3 in the first pressing step, see FIG. 1*c*.

Alternatively, or additionally, the press tool 20 may be moved in the direction Y1 for initiating the first pressing step.

FIG. 1*b* schematically illustrates the pick-up press tool 10 immersed in the container 1 holding the pulp slurry 2. While the pick-up press tool is immersed in the pulp slurry 2, the pressure regulator P1 may generate a vacuum, causing pulp fibers 3 to be drawn towards a product face of the pick-up press tool 10.

FIG. 1*c* schematically illustrates the pick-up press tool 10 moving the pulp fibers 3 towards the press tool 20, i.e. initiating the first pressing step.

During the movement, the pressure regulator P1 may generate a vacuum, causing pulp fibers 3 to stick to the product face of the pick-up press tool 10.

FIG. 1*d* schematically illustrates the pick-up press tool 10 and the press tool 20 in a pressing position. Consequently, the pick-up press tool 10 and the press tool 20 can form a pressing arrangement adapted to perform a first pressing step of the pulp slurry layer 3.

The pick-up press tool 10 and the press tool 20, and their associated tool holders 11, 21, are movable relative one another between an open position, and the pressing position. In the pressing position, as illustrated in FIG. 1*d*, the tools 10, 20 are forced towards each other, thus pressing the pulp slurry layer between the product faces of the respective tool 10, 20, such that a pulp product 3' is formed.

As illustrated in FIG. 1*d*, one, or both of the pick-up press tool and the press tool may be supplied with a heating element 13, 23. The heating elements are adapted to supply heat to the product faces of the tools.

The heating elements can be energized by an energy supply E1, E2. Further, the heating elements can be controlled by a controller C.

The heating element may be an electric heating element, hot air or liquid heating element, or induction heating element.

When in the pressing position, heat may be supplied by one, or both, of the heating elements 13, 23.

During the pressing of the pulp product 3', one or both pressure regulators P1, P2 may provide a vacuum to assist in the evacuation of water vapor from the pulp product 3'.

As an alternative, one of the pressure regulators P1, P2 may provide a vacuum while the other one provides a pressure greater than the ambient air pressure.

Optionally, hot air or steam may be introduced through the tools during the pressing process (FIG. 1*d*).

As an alternative to immersing the pick-up press in the pulp slurry, the pulp slurry can be applied by a coating operation, such as spray coating or pouring. Optionally, during the coating operation the pressure regulator P1 may generate a vacuum, causing pulp fibers 3 to be drawn towards the product face of the pick-up press tool 10.

It is also noted that two or more successive pressing steps may be used, e.g. to gradually form all or parts of the product 3', 3", 3'" and/or to apply additional features to the product, such as coatings, decors and the like.

FIG. 2*a*-2*d* illustrates a first transfer tool 30 that can be used to transfer the product 3' from the first press tools 10, 20 to a second pair of press tools 40, 50, see. FIG. 2*a*-2*e*.

The first transfer tool 30 may be connected to a third pressure regulator P3, which is capable of generating a vacuum or an air pressure. The transfer tool 30 may also be mounted on a transfer tool holder 31 so as to define a vacuum chamber 32, which is connected to the third pressure regulator P3.

During the transfer of the pulp fibers, an air pressure greater than ambient pressure may be generated by the first pressure regulator P1 to cause the pulp fibers to release from the pick-up press tool 10.

Alternatively, or as a supplement, a vacuum may be generated by the third pressure regulator P3, causing the pulp fibers to be received by the transfer tool 30.

The first transfer tool may be supplied with a heating element (not illustrated). The heating element is adapted to supply heat to a product face of the first transfer tool. The heating element can be energized by an energy supply. Further, the heating element can be controlled by a controller C.

The heating element may be an electric heating element, hot air or liquid heating element, or induction heating element.

The first transfer tool 30 is adapted to form part of the product 3', as illustrated in FIG. 2*a*-2*d*.

The first transfer tool 30 can present a porous product face.

The porous product face of the first transfer tool 30 may have a porosity of 10-90%.

The porous product face of the first transfer tool 30 may present pores with a hole size of 0.1-0.7 mm in diameter, preferably 0.25-0.6 mm.

Figure 2A:
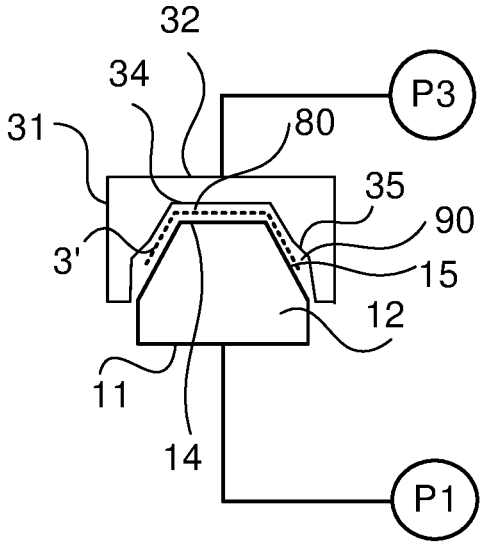
FIGS. 2*a*-2*d* schematically illustrates a transfer tool of a pick-up press device FIG. 2*e* schematically illustrates a pair of press tools.
Figure 2B:
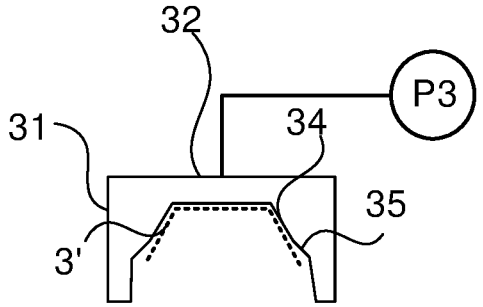

As illustrated in FIGS. 2*a* and 2*b*, the first transfer tool 30 can comprise a first forming surface portion 34 and a second forming surface portion 35.

As illustrated in FIG. 2*a*, the first forming surface portion 34 can be configured to conform to a first portion 14 of the porous first product face, such that a forming gap 80 is defined there between. The forming gap 80 can define a desired pulp slurry layer thickness.

The second forming surface portion 35 can be configured to diverge from a second portion 15 of the porous first product face, such that a non-forming space 90 is defined by the second forming surface portion 35 and a second portion 15 of the porous first product face. The non-forming space 90 can have a greater thickness than the forming gap 80.

The non-forming space 90 can be configured to provide contact between only one pulp slurry layer face and one of the second forming surface portion 35 and the second portion 15 of the porous first product face.

The non-forming space 90 can present a space between the second forming surface portion 35 and the second portion 15 of the porous first product face, that is greater than 20× a thickness of the forming gap 80, preferably greater than 15×, greater than 10×, or greater than 5× said thickness of the forming gap 80.

Figure 2C:
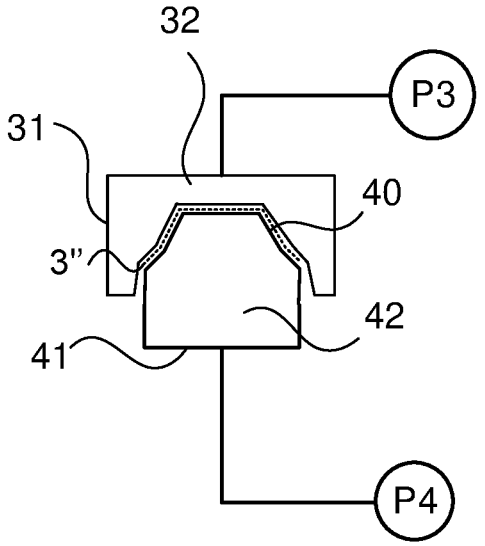
Figure 2D:
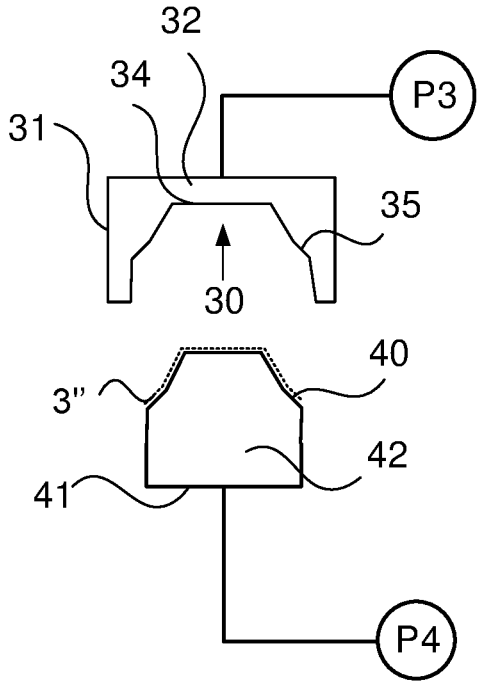
Figure 2E:
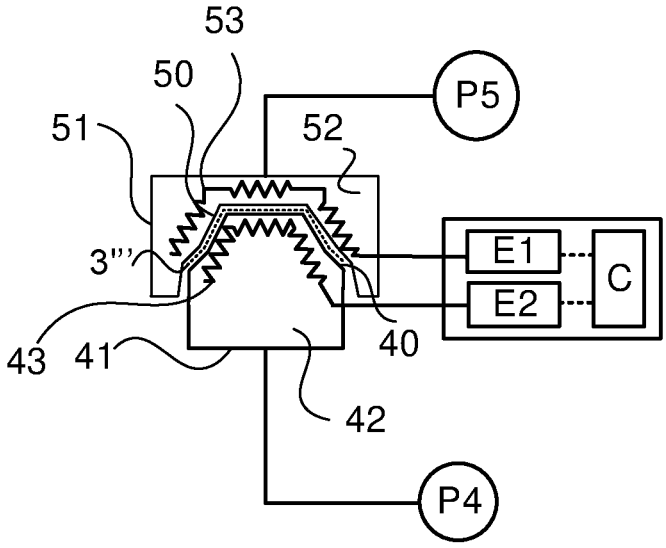
FIG. 2*f*-2*g* schematically illustrates two different embodiments of a transfer tool of a pick-up press device.
Figure 2F:
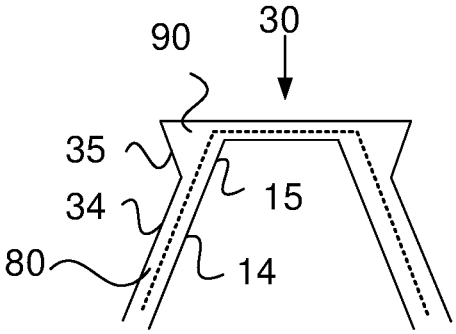

The non-forming space 90 can be provided at an innermost portion of a female mold and/or at a distal portion of a male mold, as seen in the press direction, see FIG. 2*f*.

Figure 2G:
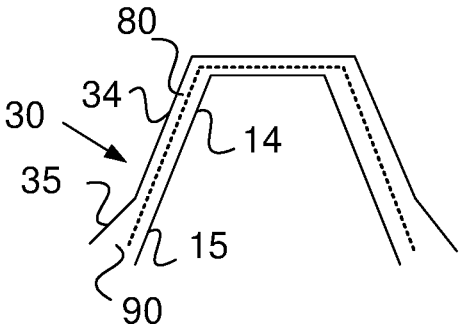

Alternatively, the non-forming space 90 can be provided at an outermost portion of a female mold and/or at a distal portion of a male mold, as seen in the press direction, see FIG. 2*g*.

The female mold may be a pick-up press tool or a press tool. The male mold may be a transfer tool.

The forming gap 80 can present a thickness that is small enough for both the forming surface portion 34 and the first portion 14 of the porous first product face to contact a respective pulp slurry layer face.

The forming gap 80 can be configured to provide a pressure on the pulp product 3' that is greater than ambient pressure.

Consequently, as the pulp product 3' is transferred from the porous first product face of the pick-up press tool 10 to the first transfer tool 30, see FIG. 2*a*, a pressure greater than ambient pressure may be applied to a portion of the pulp product 3' that is in contact with both the forming surface portion 34 of the first transfer tool 30 and the first portion 14 of the porous first product face.

The first forming surface portion 34 can be adapted to be in contact with a portion of the product 3' during a transfer of the product.

The first forming surface portion 34 can present a contact surface area that is sufficient for receiving and retaining the pulp product 3' at the first transfer tool during a movement of the first transfer tool.

The first forming surface portion 34 can present a contact surface area corresponding to 10-99.9% of the total area of the porous first product face, preferably 25-95%.

As illustrated in FIG. 2*b*, at least a portion of the pulp product 3' can be free during the movement of the first transfer tool from the first press tools 10, 20 to the second pair of press tools 40, 50.

Consequently, during a movement of the first transfer tool, transferring the pulp product 3' from the first pair of press tools 10, 20 to the second pair of press tools 40, 50, the first forming surface portion 34 can be in contact with a pulp slurry layer face and the second forming surface 35 can be free.

The shape of the porous product face of the first transfer tool 30 can substantially match the shape of a product face of a press tool of the second pair of press tools, see FIG. 2*c*.

Consequently, as the pulp product 3' is transferred to the product face of the press tool 40, the at least one free portion of the pulp product 3' can be brought into contact with second forming surface portion 35 of the first transfer tool 30. The at least one free portion of the pulp product 3' can thereby be formed as the pulp product 3' is transferred from the first transfer tool 30 to the product face of the press tool 40, see FIG. 2*c*.

The first transfer tool 30 can then be removed from the press tool 40, as illustrated in FIG. 2*d*. Then the pulp product 3" can be pressed in a second pressing step, using the second pair of press tools 40, 50, as illustrated in FIG. 2*e*.

A vacuum may be generated by the third pressure regulator P3 when the first transfer tool 30 transfers the product from the pick-up press tool 10 (FIG. 2*a*), causing the pulp fibers to be received by the transfer tool 30. Additionally or alternatively, a vacuum may be generated during the movement of the first transfer tool 30, from the first pair of press tools 10, 20 to the second pair of press tool 40, 50. Consequently, water may be evacuated from the product during the transfer.

As the first transfer tool 30 is adapted such that at least one portion of the pulp product 3' can be in contact with the porous product face of the first transfer tool 30 during the transfer, and at least one portion of the pulp product 3' can be free, i.e. not in contact, different levels of water may be evacuated from different portions of the pulp product 3'.

Consequently, the pulp product 3' transferred to the second pair of press tools 40, 50 can present a first pulp slurry layer portion and a second pulp slurry layer portion, wherein the first and second pulp slurry layer portions are juxtaposed and the first pulp slurry layer portion has a higher or lower level of water content than the second pulp slurry layer portion.

A second transfer tool may be used to transfer the pulp product 3''' from the second pair of press tools 40, 50 to a third pair of press tools (not illustrated).

The second transfer tool may be designed essentially the same as the first transfer tool or have a different design. Consequently, the second transfer tool may be used to transfer the product from the second pair of press tools to a third pair of press tools, or alternatively both transfer and form part of the product.

According to the present invention, a pick-up press device for use in a process of producing a 3D molded product from a pulp slurry is provided comprising a pick-up press tool, a press tool, a vacuum source connected to the pick-up press tool, and a first transfer tool, in accordance with what has been described with respect to FIGS. 1*a*-1*d* and FIG. 2*a*-2*e*.

According to the present invention, a method of producing a 3D molded product from a pulp slurry is also provided.

In one embodiment, steps are performed in accordance with what has been described with respect to FIGS. 1*a*-1*d* and FIG. 2*a*-2*c*.

The 3D molded product may be a receptacle, such as for example a container, cup, jar, tin, bottle etc. adapted to contain a solid, liquid and/or gaseous content.

The non-forming space 90 can then be provided at a respective portion of a press tool and transfer tool, corresponding to an opening portion of the receptacle. The opening portion may present a rim of the receptacle.

Figure 3:
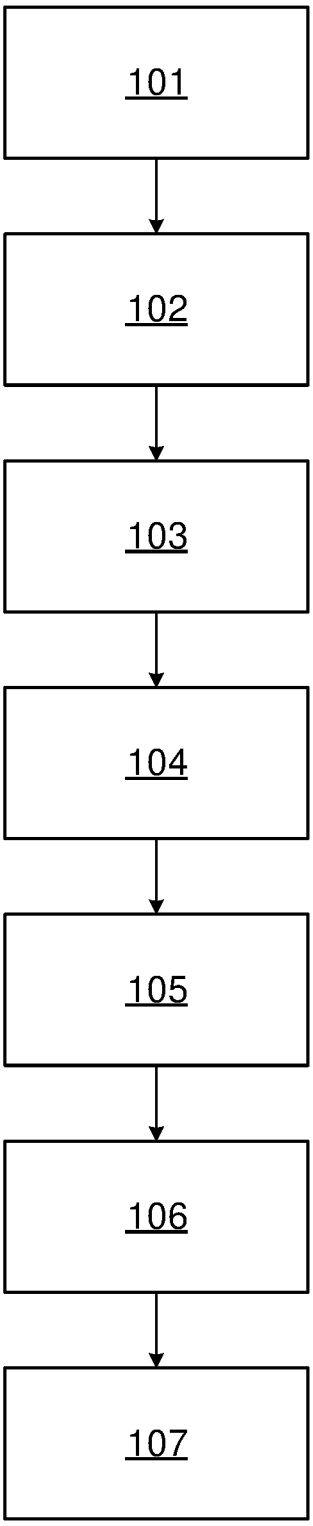
FIG. 3 schematically illustrates a production process.

Referring to FIG. 3, a production process will now be described.

In a first step 101, a pulp slurry layer is provided, e.g. as described with reference to FIG. 1*a*, wherein a pulp slurry layer is applied to a porous first product face of a first mold. This may be achieved by providing a first mold comprising a pick-up press tool, presenting the porous first product face, and a press tool, presenting a second product face. The second product face may be porous or non-porous. Alternatively, the second product face may present porous portions and non-porous portions.

The pick-up press tool may be adapted to, in the step of applying a pulp slurry layer to the porous first product face, pick up a pulp slurry layer from a pulp slurry.

The picking up of the pulp slurry layer may be performed by immersing a porous pick-up press tool of the first mold in a pulp slurry, with vacuum being applied to a rear side of the pickup-press tool.

A first pressure at a rear side of the porous first product face during the pick-up of the pulp slurry layer can be 300-700 mbarA (millibar absolute), preferably 400-600 mbarA.

A flow through the tool can be between 50 and 1000 $m^3$/h. Preferably the flow can be between 1000 and 30 000 $m^3$/h per square meter of the porous first product face of the tool.

Consequently, a vacuum can be drawn through the porous first product face of the pick-up press tool, such that a pulp slurry layer can be applied to the porous first product face.

The porous first product face of the pick-up press tool may have a surface porosity of 10-90% with hole sizes 0.1-0.7 mm in diameter, preferably 0.25-0.6 mm.

Alternatively, the pulp slurry may be applied to the pick-up press tool by a coating operation, such as spray coating or pouring. Optionally, during the coating operation a vacuum may be drawn through the porous first product face of the pick-up press tool, causing pulp fibers to be drawn towards the product face of the pick-up press tool.

In a second step 102, the pulp slurry layer is pressed in the first mold. Consequently, the pick-up press tool with the pulp slurry layer is raised from the pulp slurry or it's initial coating position, and moved towards the press tool, whereby the pulp slurry layer is pressed against the second product face of the press tool. This may be performed in one vertical movement, such that the pick-up press tool is raised and moved directly to the press tool.

Alternatively the pick-up press tool may be raised from the pulp slurry and the press tool is moved to the pick-up press tool.

Alternatively, both the pick-up press tool and the press tool may be moved in a vertical direction towards each other.

In this first pressing step 102, a pressure lower than the surrounding ambient pressure is applied at a rear side of a porous product face of the first mold, thus resulting in a vacuum at the rear side of the porous product face, causing solvent vapor, such as steam, to be drawn through the tool.

The pressure applied to the rear side of the porous product face may be on the order of low or medium level vacuum. That is, a first pressure may be 200-900 mbarA, preferably 300-800 mbarA.

A flow through the tool can be between 50 and 1000 $m^3$/h. Preferably the flow can be between 1000 and 30 000 $m^3$/h per square meter of the porous product face of the tool.

The second product face of the press tool of the first mold may be heated to about 150-500° C., preferably 150-400° C., 200-500° C., 200-400° C., or 200-300° C., and in most cases 240-280° C.

The porous first product face of the pick-up press tool of the first mold may be heated to about 100-150° C.

A pressing pressure between the product faces of the pick-up press tool and the press tool may be on the order of about 390-1570 kPa, and in most cases 580-1170 kPa.

The pressing pressure may be applied during a first pressing time of 0.1-4.0 second, preferably 0.5-2.0 second. In most settings, a pressing time on the order of 0.5-1.5 second is sufficient, and often also 0.5-1 second.

Typically, in this first step, an initial water content of the pulp slurry layer is 70-90% by weight and after the pressing step has been performed, a final water content may be 45-65% by weight, typically about 50-60% by weight.

After the first pressing step 102, the pulp slurry layer, now with a substantial amount of its solvent removed, may be transferred 103 to a second press mold. The transfer may be performed by means of a transfer tool, as described above in relation to FIG. 2*a*-2*e*. Consequently, at least a portion of the pulp slurry layer may be formed during the transfer.

During the transfer step, a vacuum may be applied to a rear side of the transferring tool wall, such that the pulp slurry layer is held to the transferring tool wall. In order to release the pulp slurry layer from the transferring tool wall, it is possible to instead apply pressurized air to the rear side of the transferring tool wall.

Alternatively, or as a supplement, a vacuum may be applied to a rear side of a porous product face of the second mold, causing the pulp slurry layer to be received by the second mold.

During the transfer, a product face of the transfer tool may be heated to about 100-150° C.

Consequently, an additional drying effect of the pulp slurry layer can be achieved and/or the pulp slurry layer can maintain a fiber warmth for formability.

The second mold may comprise a pair of mating press tools, one of which may have a porous product face, which contacts the pulp slurry layer, and through which a vacuum can be drawn.

The second mold may comprise a first press tool presenting the porous product face, and a second press tool presenting a second product face. The second product face may be porous or non-porous. Alternatively, the second product face may present porous portions and non-porous portions.

The transfer 103 may be performed by transferring the pulp slurry layer from the first mold to the porous product face of the first press tool of the second mold, by means of the transfer tool.

In a second pressing step 104, the pulp slurry layer may be pressed in the second mold. The pulp slurry layer may then be pressed against the second product face of the second press tool of the second mold. In this second pressing step 104, a pressure lower than the surrounding ambient pressure is applied at a rear side of the porous product face of the mold, thus resulting in a vacuum at the rear side of the porous product face, causing solvent vapor, such as steam, to be drawn through the tool.

The porous product face of the second mold may have a porosity of 25-50% with hole sizes 0.1-1.2 mm, preferably 0.25-1.0 mm.

However, in the second pressing step 104, the pressure applied at the rear side of the porous product face of the second mold may be higher than that provided in the first pressing step 102.

In particular, the pressure provided in the first pressing step 102 may be 1-99% of that provided in the second pressing step 104, preferably 50-99%, 90-99%, 95-99% or 99-99.9%.

In the second pressing step, the absolute pressure applied to the rear side of the porous product face of the second mold may be 200-900 mbarA, preferably 300-800 mbarA, but always greater than in the first pressing step.

A flow through the tool can be between 50 and 1000 $m^3$/h. Preferably the flow can be between 1000 and 30 000 $m^3$/h per square meter of the porous product face of the tool.

At least one of the product faces of the second mold may be heated to about 110-500° C., preferably 110-400° C., 150-500° C., 150-400° C., 200-500° C., 200-400° C., or 200-300° C., and in most cases 240-280° C. Typically, all product faces making up the second mold and contacting the pulp slurry layer may be heated.

A pressing pressure between the product faces of the first and second press tools of the second mold may be on the order of about 390-1570 kPa, and in most cases 580-1170 kPa.

The pressing pressure may be applied during a second pressing time of 0.1-4.0 second, preferably 0.5-2.0 second. In most settings, a pressing time on the order of 0.5-1.5 second is sufficient, and often also 0.5-1 second.

Typically, in this second pressing step, an initial water content of the pulp slurry layer may be about 45-65%, typically about 50-60% by weight.

A final water content may be about 25-40% by weight, preferably about 30-35% by weight.

After the second pressing step 104, the pulp slurry layer, now with a substantial amount of its solvent removed, may be transferred 105 to a third press mold. The transfer 106 may be performed in the same manner as the transfer step 103 and with similar equipment. Consequently, at least a portion of the pulp slurry layer may be formed during the transfer.

Alternatively, the equipment may differ such that the second transfer tool transfer the pulp slurry layer without forming.

The third press mold may be designed essentially as the second press mold.

The third mold may comprise a pair of mating press tools, one of which may have a porous product face, which contacts the pulp slurry layer, and through which a vacuum can be drawn.

The third mold may comprise a first press tool presenting the porous product face, and a second press tool presenting a second product face. The second product face may be porous or non-porous. Alternatively, the second product face may present porous portions and non-porous portions.

In a third pressing step 106, the pulp slurry layer may be pressed in the third mold. The pulp slurry layer may then be pressed against the second product face of the second press tool of the third mold. In this third pressing step 106, a pressure lower than the surrounding ambient pressure is applied at a rear side of the porous product face, thus resulting in a vacuum at the rear side of the porous product face, causing solvent vapor, such as steam, to be drawn through the tool.

The porous product face of the third mold may have a porosity of 25-50% with hole sizes 0.1-1.2 mm, preferably 0.25-1.0 mm.

However, in the third pressing step 106, the pressure applied at the rear side of the porous product face of the third mold may be higher than that provided in the second pressing step 104.

In particular, the pressure provided in the second pressing step 104 may be 1-99% of that provided in the third pressing step 106, preferably 50-99%, 90-99%, 95-99% or 99-99.9%.

In the third pressing step, an absolute pressure provided at the rear side of the porous product face of the third mold may be 200-900 mbarA, preferably 300-800 mbarA, but always greater than in the second pressing step.

A flow through the tool can be between 50 and 1000 $m^3$/h. Preferably the flow can be between 1000 and 30 000 $m^3$/h per square meter of the porous product face of the tool.

At least one of the product faces of the third mold may be heated to about 100-400° C., preferably 100-300° C., 150-400° C., 150-300° C., 200-300° C., or 200-280° C., and in most cases 240-280° C. Typically, all product faces making up the third mold and contacting the pulp slurry layer may be heated.

A pressing pressure between the product faces of the third mold may be on the order of about 390-1570 kPa, and in most cases 580-1170 kPa.

The pressing pressure may be applied during a third pressing time of 0.1-4.0 second, preferably 0.5-2.0 second. In most settings, a pressing time on the order of 0.5-1.5 second is sufficient, and often also 0.5-1 second.

Typically, in this third pressing step, an initial water content of the pulp slurry layer may be about 25-45% or 25-40% by weight, preferably about 30-40% or 30-35% by weight, and a final water content may be less than about 5% by weight, preferably less than about 1% by weight.

After the third pressing step 106, the pulp slurry layer, now with most of its solvent removed, may be transferred 107 out of the machine.

Optionally, additional steps, such as surface treatment, cutting or printing may be performed on the thus essentially dry product. The product may then be packaged, stored and shipped.

It is noted that the third pressing step 106, and thus also its related transfer step 105, is optional. Hence, the process may be finished after the second pressing step 104 with the output step 107 following immediately.

Thus, in the first pressing step, an initial water content of the pulp slurry layer may be 70-90% by weight and a final water content may be 25-50% by weight, preferably about 30-35% by weight.

In the second pressing step, an initial water content of the pulp slurry layer may be about 25-50%, preferably about 30-35% by weight, and a final water content may be less than about 5% by weight, preferably less than about 1% by weight.

Further, the method may comprise at least one optional washing step of the pulp slurry layer. The washing step may be performed after the transfer step 103 and before the second pressing step 104 and/or after the transfer step 105 and before the third pressing step 106.

Further, the method may comprise at least one step wherein a laminate or a coating is applied to the pulp slurry layer or pulp product. The laminate or coating may be applied between the first and second pressing step, or between the second and third pressing step, or after the third pressing step.

It is noted that the vacuum sources provided must be dimensioned so as to provide a flow that is sufficient to evacuate the amount of steam generated during the heating/pressing steps, and also to accommodate the liquid water that is drawn out by the vacuum applied to the respective mold.

The invention claimed is:

1. A device for use in a process of producing a 3D molded product from a pulp slurry comprising:

a pick-up press tool presenting a porous first product face, and a press tool presenting a second product face, and wherein the pick-up press tool is provided with at least one heating element adapted to supply heat to the porous first product face of the pick-up press tool and/or the press tool is provided with at least one heating element adapted to supply heat to the second product face of the press tool, and the pick-up press tool is provided with a vacuum source adapted to draw a vacuum through a porous product face of at least one of the tools, wherein the pick-up press tool and the press tool are vertically movable relative one another, wherein, in a first relative position of the press tools, at least one of the product faces is positioned so as to receive a pulp slurry layer in liquid form to its product face, and wherein in a second relative position of the press tools, the product faces are pressed towards each other for pressing the pulp slurry layer, wherein the device further comprises a first transfer tool, wherein the first transfer tool comprises:

a first forming surface portion, configured to conform to a first portion of the porous first product face of the pick-up press tool, such that a forming gap is defined there between, said forming gap defining a desired pulp slurry layer thickness, and a second forming surface portion, configured to diverge from a second portion of the porous first product face of the pick-up press tool, such that a non-forming space is defined by the second forming surface portion and the second portion of the porous first product face of the pick-up press tool, said non-forming space having a greater thickness than the forming gap, wherein the device further comprises a second mold configured to receive product from the first transfer tool and carry out a second forming step, the second mold comprising a first press tool comprising a first product face, and a second press tool comprising a second product face;

wherein at least one of the first product face and the second product face is porous, wherein at least one of the first press tool and the second press tool is provided with at least one heating element adapted to supply heat to the first product face and/or the second product face; and wherein the second mold is provided with a vacuum source adapted to draw a vacuum through a porous product face of at least one of the first product face and the second product face, wherein the vacuum source for the second mold is the same or different from the vacuum source of the pick-up press tool.

2. The device according claim 1, wherein the non-forming space is configured to provide contact between only one pulp slurry layer face and one of the second forming surface portion and the second portion of the porous first product face.

3. The device according to claim 1, wherein the non-forming space presents a space between the second forming surface portion and the second portion of the porous first product face of the pick-up press tool, that is greater than 20× of said thickness of the forming gap.

4. The device according to claim 1, wherein the non-forming space presents a space between the second forming surface portion and the second portion of the porous first product face of the pick-up press tool, that is greater than 15× of said thickness of the forming gap.

5. The device according to claim 1, wherein the non-forming space is provided at an innermost portion of a female mold and/or at a distal portion of a male mold, as seen in the press direction.

6. The device according to claim 1, wherein the non-forming space is provided at an outermost portion of a female mold and/or at a distal portion of a male mold, as seen in the press direction.

7. The device according to claim 1, wherein the forming gap presents a thickness that is small enough for both the first forming surface portion and the first portion of the porous first product face of the pick-up press tool to contact a respective pulp slurry layer face.

8. The device according to claim 1, wherein the first forming surface portion presents a contact surface area corresponding to 10-99.9% of the total area of the porous first product face of the pick-up press tool.

9. The device according to claim 1, wherein the first transfer tool presents a porous product face having a porosity of 10-90%.

10. The device according to claim 9, wherein the porous product face of the first transfer tool presents pores with a hole size of 0.1-0.7 mm in diameter.

11. A method of producing a 3D molded product from a pulp slurry, comprising:

applying, in liquid form, a pulp slurry layer to a porous first product face of a pick-up press tool of a first mold;

in a first forming step, pressing the pulp slurry layer on the porous first product face of the pick-up press tool against a second product face of a cooperating press tool of the first mold, while heating the pulp slurry layer and drawing a vacuum through a porous product face of at least one of the tools;

transferring the pulp slurry layer to a porous product face of a first press tool of a second mold, in a second, subsequent, forming step, pressing the pulp slurry layer against a second product face of a second press tool of the second mold, while heating the pulp slurry layer and drawing a vacuum through a porous product face of at least one of the first and second press tools of the second mold;

wherein at least a portion of the pulp slurry layer is formed during the transfer to the first press tool of the second mold;

wherein the transfer of the pulp slurry layer from the first mold to the second mold is performed by means of a first transfer tool, the first transfer tool comprising a first forming surface portion and a second forming surface portion;

wherein, during a transfer of the pulp slurry layer from the first mold to the first transfer tool, the first forming surface portion conforms to a first portion of the porous first product face of the pick-up press tool, such that a forming gap is defined there between, the forming gap defining a desired pulp slurry layer thickness; and wherein the second forming surface portion diverges from a second portion of the porous first product face of the pick-up press tool, such that a non-forming space is defined by the second forming surface portion and the second portion of the porous first product face of the pick-up press tool, the non-forming space having a greater thickness than the forming gap.

12. The method according to claim 11, wherein, during a transfer of the pulp slurry layer from the first mold to the first transfer tool, the forming gap provides a pressure on the pulp slurry layer that is greater than ambient pressure.

13. The method as claimed in claim 11, wherein, during a movement of the first transfer tool from the first mold to the second mold, the first forming surface portion is in contact with a pulp slurry layer face and the second forming surface portion is free.

14. The method as claimed in claim 11, wherein during the transfer of the pulp slurry layer from the first mold to the second mold, a vacuum is drawn through the first transfer tool such that at least some water is evacuated from the pulp slurry layer.

15. The method as claimed in claim 11, wherein the pulp slurry layer transferred to the second mold presents a first pulp slurry layer portion and a second pulp slurry layer portion, wherein the first and second pulp slurry layer portions are juxtaposed and the first pulp slurry layer portion has a higher or lower level of water content than the second pulp slurry layer portion.

16. A method of forming a receptacle, comprising the method as claimed in claim 11, wherein the non-forming space is provided at a respective portion of a press tool and transfer tool corresponding to an opening portion of the receptacle.

* * * * *